United States Patent [19]

Göhler et al.

[11] 4,325,709

[45] Apr. 20, 1982

[54] METHOD FOR THE OPERATION OF GASIFICATION PLANTS FOR PULVERIZED FUELS

[75] Inventors: Peter Göhler, Freiberg; Peter Jaschke, Ossling; Horst Kretzschmer, Freiberg; Claus-Otto Kuhlbrodt, Freiberg; Klaus Lucas, Freiberg; Berthold Neumann, Hoyerswerda; Manfred Schingnitz; Hans-Joachim Schweigel, both of Freiberg; Friedrich Berger, Brand-Erbisdorf; Dieter König, Freiberg, all of German Democratic Rep.

[73] Assignee: Brennstoffinstitut Freiberg, Freiberg, German Democratic Rep.

[21] Appl. No.: 40,052

[22] Filed: May 17, 1979

[30] Foreign Application Priority Data

May 31, 1978 [DD] German Democratic Rep. ... 205679

[51] Int. Cl.[3] ..... C10J 3/46

[52] U.S. Cl. ..... 48/197 R; 48/206; 48/210; 48/DIG. 4; 252/373; 431/6

[58] Field of Search ..... 48/197 R, 200, 201, 48/203, 206, 210, DIG. 4; 252/373; 110/101 CF, 262; 431/90, 6

[56] References Cited

U.S. PATENT DOCUMENTS

| | | | |
|---|---|---|---|
| 2,395,384 | 2/1946 | Ziebolz | 431/90 |
| 2,919,980 | 1/1960 | Klapp et al. | 48/DIG. 4 |
| 3,159,345 | 12/1964 | Osburn | 431/90 |
| 4,017,269 | 4/1977 | Dutz et al. | 48/DIG. 4 |
| 4,017,272 | 4/1977 | Anwar et al. | 48/DIG. 4 |
| 4,032,287 | 6/1977 | Blum et al. | 110/262 |

*Primary Examiner*—Peter F. Kratz
*Attorney, Agent, or Firm*—Michael J. Striker

[57] ABSTRACT

The invention concerns a method for the operation of gasification plants for pulverized fuels, wherein the pulverized fuel is reacted in a flame reaction with a gasifying agent containing free oxygen, into a combustible gas containing CO and $H_2$. The task consists in precluding upon malfunctions in the supply of fuel, an oxygen discharge into the cooling and treatment plants, taking into consideration delays in the emergency shut-off systems and the controls for the oxygen supply.

As per invention, a well-flowing additional fuel is stored in a reservoir at a pressure higher than the operating pressure of the gasification reactor. Upon malfunctions in the fuel supply, the additionally stored fuel will be transferred, within a short time, into the reaction chamber of the gasification plant. As additional well-flowing fuel combustible gas, liquid fuel or a pulverized solid fuel, also well-flowing, can be used.

10 Claims, 2 Drawing Figures

METHOD FOR THE OPERATION OF GASIFICATION PLANTS FOR PULVERIZED FUELS

BACKGROUND OF THE INVENTION

The invention concerns a method for the operation of gasification plants for pulverized fuels which, in particular, will raise the technical safety of such plants in cases of malfunctions.

In the technology of producing from solid fuels, synthesis gas, reduction gas, heating gas, and gas for public utilities, the gasification of pulverized fuels by partial oxidation, has shown to be an advantageous solution. With a method of this type, the pulverized fuel is reacted in a flame reaction, for instance, within a temperature range from 1200° C. to 1600° C. at normal or increased pressure, with a gaseous oxidizing agent containing free oxygen, called hereunder 'gasifying agent', wherein essentially CO and $H_2$ will be generated. The reaction takes place in an empty reaction chamber, where average dwelling times in the hot reaction chamber, of the fuel and the gas resulting therefrom, will be of the magnitude of 0.5 s to 10 s. The gasifying agent is, as a rule, a mixture of technical oxygen and steam, wherein the content of technical oxygen will be between 60% and 95%, depending upon the fuel and the intended use of the gas.

Control of the method, in particular of maintaining optimal temperatures in the reaction chamber, is effected by controlling the ratio of technical oxygen to pulverized fuel, wherein deviations of 10% of the present value of the mass ratio of oxygen to fuel, may already lead to concomitant variations of the temperature within the reaction chamber by 200 K. When operating such a gasification plant, the danger exists that upon malfunctions in the fuel suppy especially upon an unintended reduction in the supply of the pulverized fuel, the temperatures within the reaction chamber will rise to such high values that the technical safety of the plant is questionable.

If the flow of pulverized fuel is reduced so far that the ratio of oxygen to fuel will exceed the stoichiometric amount required for complete combustion, or if the supply of pulverized fuel is fully interrupted, the oxygen, which is now present in excess, can react for a short while with the previously produced quantity of CO and $H_2$ which is present within the hot reaction chamber. If the supply of oxygen is not securely shut off by the end of this phase, the temperature in the reaction chamber will drop again, however the danger remains of non-reacted free oxygen from the hot reaction chamber intruding into the subsequently arranged cooling and treatment apparatus for the produced gas, leading therein to the formation of explosive mixtures of oxygen and combustible hydrogen-containing gas and initiating severe explosions. To avoid such dangerous situations dust gasification plants of this type are equipped with an automatic emergency shut-off system which will securely close the oxygen supply and transfer the plant into a safe state, especially when the preset flow of pulverized fuel is not maintained, when the preset flow of oxygen is exceeded, and when the preset temperature range in the reaction chamber is either exceeded or not reached.

The automatic emergency shut-off will, because of the design, suffer a delay which is essentially determined by the delay in registering the measured values by the controls, and by the closing time of valves for the oxygen supply. With high capacity plants in particular, this closing time may be in the range of several seconds and may essentially determine the total delay. Despite the length of this closing time, sufficient safety against an oxygen discharge can be attained in case of a sudden interruption in the supply of pulverized fuel, if the ratio of the oxygen quantity flowing per time unit to the quantity of CO and $H_2$ normally present in the reactor, can be made sufficiently small, and if provision is made for sufficient re-circulation within the reactor. Such a solution will, however, lead to low specific outputs of the reactor and thus to very large dimensions of the reactor. Another solution provides for sub-dividing the reaction chamber into several sections, which are operated largely independent of each other, each with its own supply system for fuel and gasifying agent, wherein, in case of a malfunction, any non-reacted oxygen that may in a given case be left in one of the sections, can react with gas produced in the other sections of the reaction chamber before a discharge into the cold parts of the plant could occur. This solution, too, is concatenated to increased expenditure for apparatus.

The objective of the invention is a method for the operation of gasification plants for pulverized fuels, which will preclude the danger of an oxygen discharge into the cooling and treatment plant for the produced gas, in case of malfunctions in the supply of pulverized fuel to the reactor, especially in case of a sudden interruption of this supply.

SUMMARY OF THE INVENTION

The invention is based upon the task of creating a method for the operation of gasification plants for pulverized fuels which, under consideration of the final closing times of automatically controlled closing organs, will preclude the danger of an oxygen discharge into the cooling and treatment plants for the produced gas in case of malfunctions in the supply of pulverized fuel to the reactor, especially in case of a sudden interruption of this supply, and which will allow high specific fuel-combustion space ratios for the reaction chamber, and which is suitable for high capacity plants. As per invention, the set task is solved by storing in a suitable reservoir, at a pressure higher than the operating pressure of the reactor, a well-flowing fuel, connecting this reservoir with the reaction chamber of the reactor by piping, which, during normal operation, can be closed by means of automatically controlled shut-off organs in such a manner that upon opening of the shut-off valve, the well-flowing additional fuel can enter the reactor close to the entry point for the oxygen-containing gasifying agents, wherein simultaneously with triggering of the automatic emergency shut-off, the shut-off organ will open automatically and the existing pressure differential will cause a transfer into the reactor of the well-flowing additional fuel stored in the reservoir. The well-flowing additional fuel reaching the reactor will, due to the high temperatures prevailing within the reaction chamber, react with the oxygen quantities still flowing into the reaction chamber until the automatic shut-off is fully effective, and will thus prevent an oxygen discharge.

As per invention, pressure and capacity of the reservoir as well as the resistance to flow of the connection between reservoir and the reaction chamber, will be in such a relation that the quantity of well-flowing additional fuel transferred into the reaction chamber during the time interval between triggering the emergency shut-off and complete closing of the oxygen supply to the reactor, will be larger than the quantity which is stoichiometrically required for the complete bonding of the oxygen flowing in during this interval. There are no additional demands regarding quantity regulation of this additional fuel.

With the solution as per invention, the choosing, in the known manner, of the type of well-flowing additional fuel or of the pressure in the reservoir, will make it easy to manage with such close cross sections of the connecting piping between reservoir and reaction chamber, that the opening time of the shut-off organ in the connecting piping will be small in relation to the closing time of the shut-off organs in the oxygen supply line.

The efficacy of the solution as per invention is also given when the opening time of the shut-off organ in the aforenamed connecting piping cannot be neglected any more in relation to the closing time of the shut-off organs in the oxygen supply line. According to the flow characteristics of the usual shut-off valves and the maximum value of the pressure differential between reservoir and reaction chamber prevailing at the moment of triggering the emergency shut-off, a large flow of the additional fuel when compared to the maximum through-put, will already be reached with a moderate movement of the shut-off valve, whilst in reverse, the oxygen supply will show a stronger drop only shortly before reaching the end position of the oxygen shut-off organ.

With a preferred design of the invention, a combustible gas with high calorific value, from own product or from an outside origin (f.i. natural gas) is used as the well-flowing additional fuel. Another version of the invention utilizes liquid fuels, wherein sufficient pressure in the reservoir is ensured by the own vapor pressure of the liquid fuel or by pressurizing with inert or combustible gases. On utilizing liquid fuels, application is recommended of such fuels that are well-flowing at ambient temperature and do not tend to form rosin or other solid precipitates. Utilization of high-quality and expensive fuels for this purpose is economically tolerable, since the requirement for this additional fuel is very small in relation to the output of the plant. If additional expenditure as to apparatus, f.i. heating, can be agreed to, the principle of the invention may be applied, if needed, also to the utilization of medium or heavy fuel oils.

Finally, it is also possible as per invention, to use also well-flowing pulverized solid fuels as the well-flowing additional fuel, wherein the reservoir for the additional fuel is a vessel pressurized with an inert or combustible gas to a pressure higher than the operating pressure of the reactor, and which is preferably arranged geodetically higher than the inlet opening into the reactor. Design and action of such a vessel are known from the technology of pneumatic materials handling.

The pulverized fuel used for this purpose may be identical with the pulverized fuel used for gasification, however, for the attainment of better flow it may also be a fraction obtained from the main fuel by additional preparation such as screening or sifting, or it may be manufactured by a separate preparation method particularly suitable for the attainment of light-flowing characteristics.

For the application of the invention it is of no importance in which form and by which means the pulverized fuel is supplied during normal operation to the burner or burners of the gasification reactor. The invention can also be applied with advantage if other well-flowing fuels are fed into the gasification reactor simultaneously with the pulverized fuel and reacted therein, with the gasifying agent containing free oxygen, to gas containing CO and $H_2$.

The invention may be utilized in particular also when the pulverized fuel is fed into the gasification reactor suspended in a liquid fuel such as fuel oil or tar.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The invention is to be explained by two examples as designed and by the relative FIGS. 1 and 2.

DESCRIPTION OF THE PREFERRED EMBODIMENTS

Figure 1:
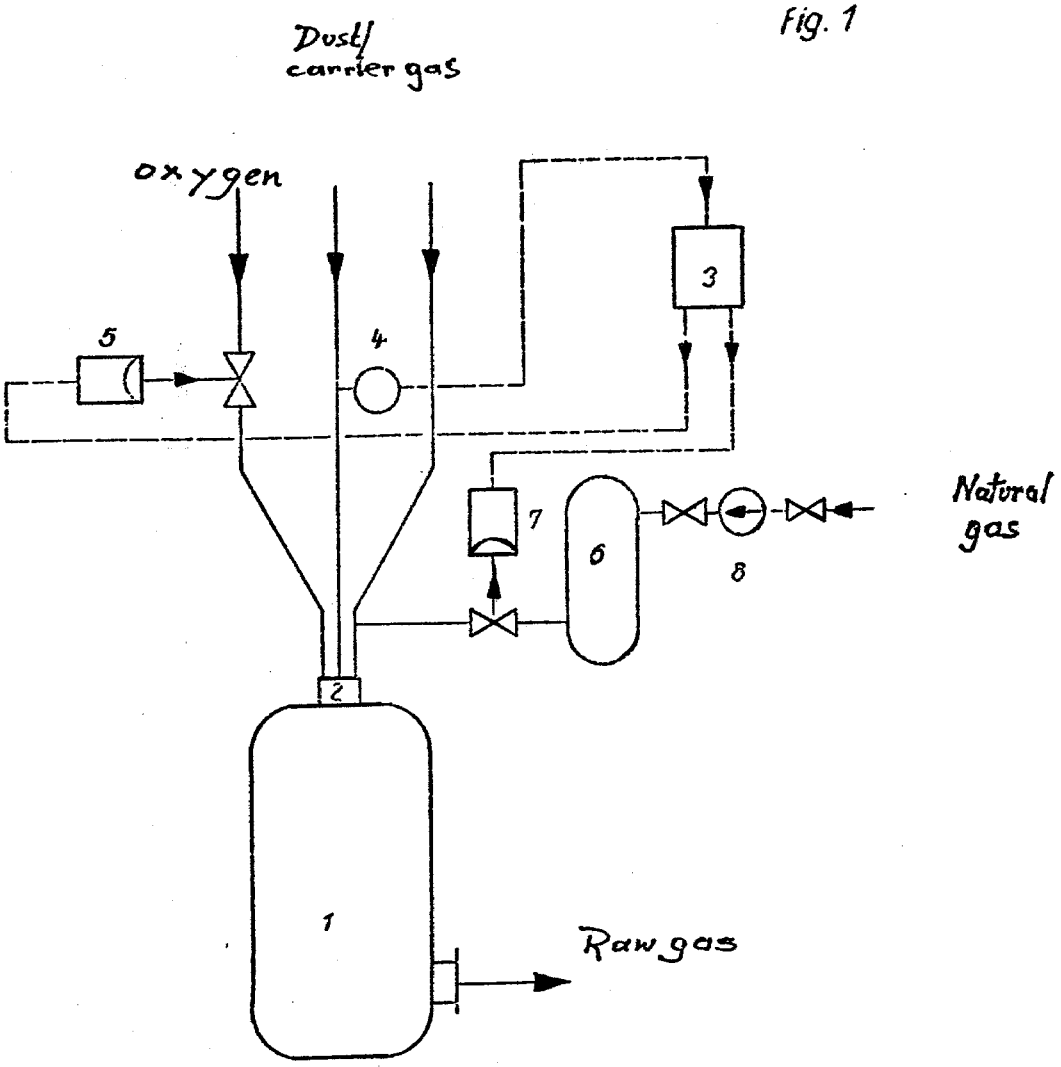
FIG. 1 represents a version of the invention wherein a combustible gas is used as the well-flowing additional fuel (design example 1).
Figure 2:
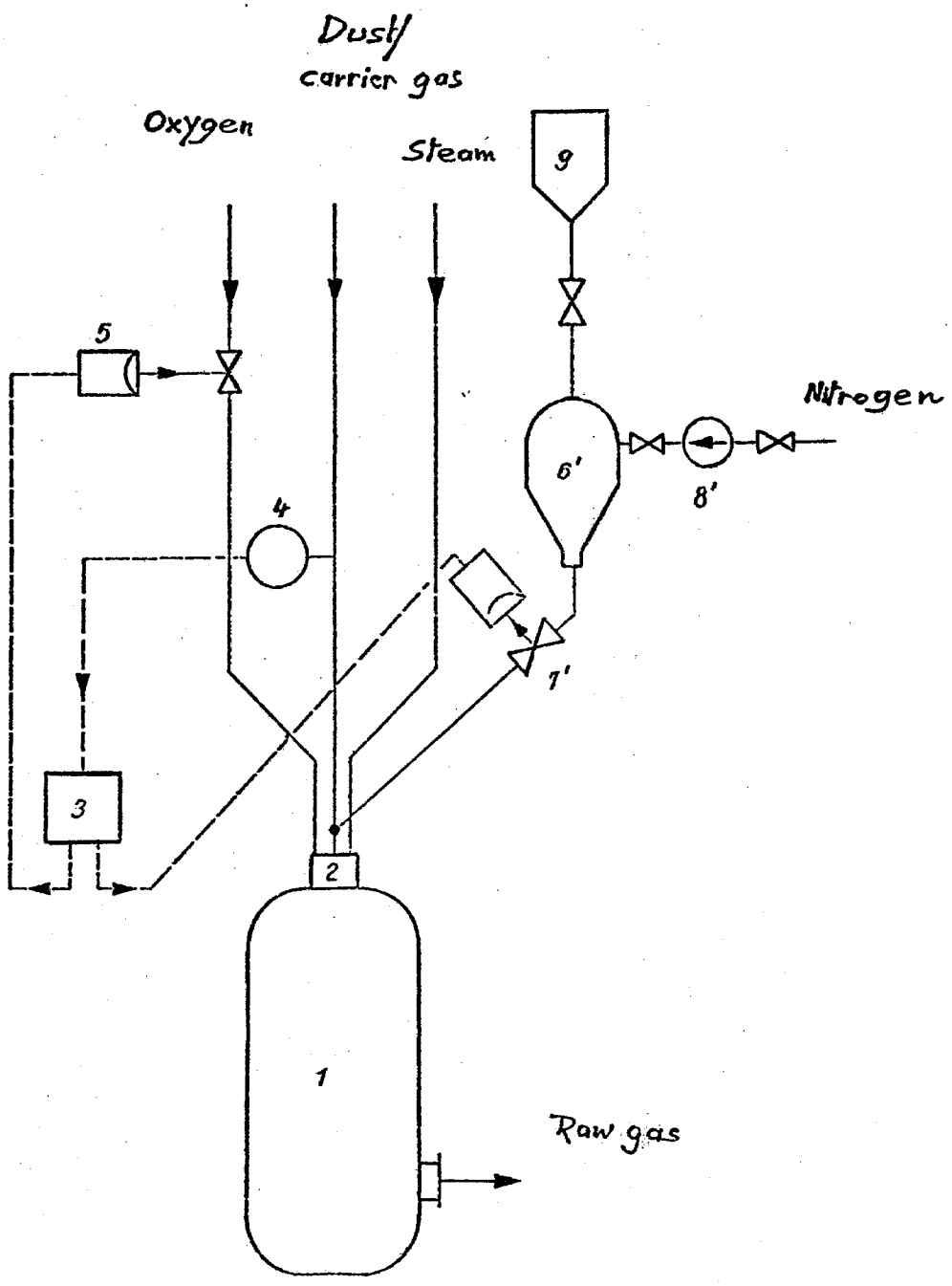
FIG. 2, however, represents the arrangement when utilizing a well-flowing pulverized fuel (design example 2).

1. A dust gasification reactor 1 was designed for an operating pressure of 2.5 MPa and an output of 50,000 $m^3$ NTP/h of raw gas. Pulverized fuel in the form of a dense suspension in an inert carrier gas, technical oxygen, and steam are introduced by a burner 2, at the head of the reactor, into the reaction chamber, where the commingling of the three streams ensues in the reaction chamber immediately after their exit from the mouth of the burner. The requirement of technical oxygen amounts to 14,000 $m^3$ NTP/h, increasing with a purity of the technical oxygen of 96% to a quantity of, respectively, pure oxygen of 13,400 $m^3$ NTP/h or 3.7 $m^3$ NTP/s. The reactor is equipped with an automatic emergency shut-off system shown in FIG. 1 as small box 3.

The delay from the occurrence of a malfunction in the fuel supply, (exceeding of a lower limit value) which will be indicated by the dust flow meter 4, to the beginning of the shut-off sequences, amounts to 7 s. After a further 5 s, the oxygen supply will be completely shut-off by the valve 5. During the first phase of the delay, 26 $m^3$ NTP of $O_2$ will flow into the reactor, and during the second phase of the delay, caused by the closing of the $O_2$ shut-off valve, 15 $m^3$ NTP of $O_2$ (an average of 80% of the normal flow) will continue to flow in. As per invention, the plant is equipped with a pressure vessel 6 in which methane (natural gas) is stored at a pressure of 3.2 MPa.

The pressure vessel is connected via piping with the steam inlet nozzle of the burner 2. On triggering an emergency shut-off by the automatic emergency shut-off system 3, the valve 7 opens and the natural gas from the vessel 6 will expand into the reactor 1 until the pressure is equalized. The vessel 6 has a volume of 6 $m^3$ so that upon emergency shut-off approximately 40 $m^3$ NTP of natural gas will flow into the reactor. The natural gas reacts with the free oxygen which is flowing in, wherein a maximum of 20.5 $m^3$ NTP are required for the bonding of the oxygen. The remainder has the effect of an additional cooling medium.

Before putting the gasification plant into operation, it is to be made certain that the vessel 6' is pressurized with natural gas, up to the prescribed pressure, with the aid of the compressor 8.

For the gasification reactor as per design example 2, a well-flowing pulverized brown coal is available instead of natural gas, for the shut-off sequences. The pulverized brown coal is stored in the pressure vessel 6', with a quantity of 130 kg, wherein a pressure of 3.2 MPa is maintained through pressurizing with nitrogen by means of the nitrogen compressor 8'. The vessel has a total volume of 6 $m^3$, of which a portion of about 0.25 $m^3$ is filled with dust. The pressure vessel 6', is arranged geodetically higher than the burner 2 of reactor 1, and connected by piping with the coal dust inlet nozzle of burner 2. On triggering an emergency shut-off by the automatic emergency shut-off system 3, the shut-off organ 7' which is suitable for the passage of pulverized coal, is then opened and the nitrogen stored in the vessel 6', completely entraining the dust contained in the vessel 6', will expand into the reactor 1 until pressure equalization is reached.

The dust will react with the oxygen continuing to flow into the reactor, wherein stoichiometrically 40 kg of dust are required for the complete bonding of the oxygen. The excess quantity will compensate for incomplete combustion of the dust.

Before putting into operation of the plant, it is to be made certain that the vessel 6' which is initially under atmospheric pressure, is filled with the required amount of coal dust out of the storage bin 9 and then pressurized with nitrogen to the required storage pressure of 3 MPa.

It will be understood that each of the elements described above, or two or more together, may also find a useful application in other types of methods for the operation of gasification plants for pulverized fuels differing from the types described above.

While the invention has been illustrated and described as embodied a method for the operation of gasification plants for pulverized fuels, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Method for the operation of gasification plants for pulverized fuels, of the type wherein pulverized fuel is supplied to a reactor by mechanical means or suspended in a combustible or non-combustible gaseous or liquid medium, and reacted, in a flame reaction with a gasifying agent containing free oxygen, into a combustible gas containing CO and $H_2$, the improvement comprising storing in a suitable reservoir a well-flowing additional fuel at a pressure higher than the operating pressure of the gasification plant; and transferring within a short time, in case of malfunctions in the supply of the pulverized fuel, said well-flowing fuel stored in the reservoir by the pressure within the reservoir into the reaction chamber of the gasification plant, wherein introduction of the aforenamed well-flowing fuel is made near the inlet location for the free-oxygen containing gasifying agent and wherein pressure, storage volume of the reservoir, and flow resistance of the connection between reservoir and the reaction chamber of the gasification reactor are in such relation that the quantity of well-flowing additional fuel transferred into the reaction chamber during the time interval between the start of a malfunction causing a shut off and the complete cut off of the supply of free oxygen will be greater than the quantity that is stoichiometrically required for the bonding of free oxygen flowing into the reaction chamber during this time interval.

2. Method according to claim 1, wherein said additional fuel is a combustible gas.

3. Method according to claim 2, wherein said combustible gas has a high calorific value.

4. Method according to claim 2, wherein said combustible gas is natural gas.

5. Method according to claim 1, wherein said well-flowing fuel is a liquid fuel.

6. Method according to claim 5, wherein the pressure in the reservoir is generated by the vapor pressure of the liquid fuel.

7. Method according to claim 5, wherein the pressure in the reservoir is generated by pressurizing with a combustible or inert gaseous medium.

8. Method according to claim 1, wherein said well-flowing fuel is a pulverized solid fuel and wherein the pressure in the reservoir is generated by pressurizing with a combustible or inert gaseous medium.

9. Method according to claim 8, wherein said pulverized solid fuel is pulverized brown coal.

10. Method according to claim 1, wherein said gasifying agent contains steam in addition to free oxygen.

* * * * *